US012520897B2

(12) United States Patent
Fu et al.

(10) Patent No.: US 12,520,897 B2
(45) Date of Patent: Jan. 13, 2026

(54) SAWDUST HELMET AND MANUFACTURING METHOD

(71) Applicant: Dongguan City EON Sporting Goods Co., Ltd., Dongguan (CN)

(72) Inventors: Jiabing Fu, Dongguan (CN); Guoding Wang, Dongguan (CN)

(73) Assignee: Dongguan City EON Sporting Goods Co., Ltd., Dongguan (CN)

( * ) Notice: Subject to any disclaimer, the term of this patent is extended or adjusted under 35 U.S.C. 154(b) by 0 days.

(21) Appl. No.: 18/497,206

(22) Filed: Oct. 30, 2023

(65) Prior Publication Data

US 2024/0057705 A1 Feb. 22, 2024

(30) Foreign Application Priority Data

Aug. 9, 2023 (CN) ..... 202310997288.3

(51) Int. Cl.
*A42B 3/06* (2006.01)

(52) U.S. Cl.
CPC ..... *A42B 3/06* (2013.01)

(58) Field of Classification Search
CPC ..... A42B 3/06; A42B 3/128; A42B 3/125; A42B 3/121
See application file for complete search history.

(56) References Cited

U.S. PATENT DOCUMENTS

| | | | | |
|---|---|---|---|---|
| 3,447,163 | A * | 6/1969 | Tojeiro | A42B 3/065 428/116 |
| 4,006,496 | A * | 2/1977 | Marker | A42B 3/128 2/414 |
| 10,588,372 | B2 * | 3/2020 | Ho | A42B 3/124 |
| 2007/0000032 | A1 * | 1/2007 | Morgan | A42B 3/124 2/412 |
| 2010/0000009 | A1 * | 1/2010 | Morgan | A42B 3/128 2/414 |
| 2012/0198604 | A1 * | 8/2012 | Weber | A42B 3/064 2/410 |
| 2012/0317704 | A1 * | 12/2012 | Coyle | A42B 3/06 2/411 |
| 2015/0335091 | A1 | 11/2015 | Erb et al. | |
| 2015/0335092 | A1 | 11/2015 | Erb et al. | |
| 2018/0255861 | A1 * | 9/2018 | Ho | A42B 3/124 |
| 2018/0255862 | A1 * | 9/2018 | Ho | A42B 3/064 |
| 2019/0328072 | A1 | 10/2019 | Hoshizaki | |

* cited by examiner

*Primary Examiner* — Haley A Smith
(74) *Attorney, Agent, or Firm* — Zhigang Ma

(57) ABSTRACT

The present invention provides a sawdust helmet and a manufacturing method. The sawdust helmet comprises an outer housing; a buffer body containing sawdust is installed at the inner side of the outer housing; the buffer body is integrally formed, and the size of the buffer body is adapted with the size of the outer housing; a fabric inner cushion body is padded at the inner side of the buffer body; and a helmet belt is fixedly installed at the bottom of the outer housing. The buffer body is composed of a sawdust layer and a foam material layer. The sawdust layer is composed of cork chips or non-cork chips. The buffer body is composed of the sawdust layer and the foam material layer, and the decorative pattern formed by the sawdust can increase the beauty of the helmet.

2 Claims, 8 Drawing Sheets

SAWDUST HELMET AND MANUFACTURING METHOD

TECHNICAL FIELD

The present invention belongs to the technical field of helmets, and particularly relates to a sawdust helmet and a manufacturing method.

BACKGROUND

The existing helmet is generally composed of a helmet body, an inner buffer layer and a wearing device, wherein the helmet body is generally made of hard materials. The buffer layer (body) is arranged on the inner surface of the helmet body for absorbing the impact force generated, and the wearing device is used for fixing the helmet body to the head of a human body.

The buffer layer inside the helmet on the market is basically made of plastic materials, such as EPS, EPP, etc., and there are certain shortcomings in the use process:

The buffer layer has single material and single color. For beautification, the surface is often painted with color ink, film, etc., which increases the processing complexity of the buffer layer and also increases the production cost to a certain extent.

Moreover, the texture of the buffer layer is not particularly good. The texture is single. According to different used materials, the buffer layer is either hard or soft. Based on this, in order to increase the beauty of the buffer layer of the helmet and improve a good feeling of contact between the buffer layer of the helmet and the head (such as softness, comfort, etc.), providing a helmet including a sawdust buffer body has good market prospects.

SUMMARY

The purpose of the present invention is to provide a sawdust helmet and a manufacturing method to solve problems proposed in the background.

To achieve the above purpose, the present invention provides the following technical solution: a sawdust helmet comprises an outer housing; a buffer body containing sawdust is installed at the inner side of the outer housing; the buffer body is integrally formed, and the size of the buffer body is adapted with the size of the outer housing; a fabric inner cushion body is padded at the inner side of the buffer body; and a helmet belt is fixedly installed at the bottom of the outer housing.

The buffer body is composed of a sawdust layer and a foam material layer;

The sawdust layer is composed of cork chips or non-cork chips.

As a preferred solution of the present invention, the foam material layer has two layers, and the sawdust layer is pressed in the middle of the two foam material layers.

As a preferred solution of the present invention, the foam material layer is provided with a plurality of grooves; the sawdust layer is provided with bulges adapted with the grooves; and when the foam material layers and the sawdust layer are pressed, the bulges are buckled inside the grooves.

As a preferred solution of the present invention, the foam material layer has three layers; the sawdust layer is arranged between two adjacent foam material layers, and a plurality of wedge blocks are connected between the two sawdust layers penetratively; the surfaces of the foam material layers are provided with wedge grooves adapted with the sizes of the wedge blocks; and when the foam material layers and the sawdust layers are pressed, the wedge blocks are buckled inside the wedge grooves.

As a preferred solution of the present invention, the sawdust layer is a round or polygonal sawdust insert; the surface of the foam material layer is provided with an embedding groove adapted with the sawdust insert; and when the foam material layer and the sawdust layer are pressed, the sawdust insert is buckled inside the embedding groove.

As a preferred solution of the present invention, the bottom of the sawdust layer is provided with a wavy first arc part; the surface of the foam material layer is provided with a wavy second arc part; and when the foam material layer and the sawdust layer are pressed, the first arc part and the second arc part are closely fitted.

A manufacturing method of the sawdust helmet, used for manufacturing the sawdust helmet of any one of the above, comprises the following steps:

S1, conducting injection molding of the outer housing;

S2, processing the buffer body comprising the sawdust layer and the foam material layer;

S3, processing the fabric inner cushion body; after the buffer body and the outer housing are assembled, padding the inner cushion body at the inner side of the buffer body, and then selecting an appropriate helmet belt for installation with the outer housing.

As a preferred solution of the present invention, in the step S2, the sawdust of the sawdust layer is evenly or unevenly distributed on the surface of the foam material layer; then the buffer body is processed by extrusion and high temperature steam forming; and the number, size and shape of the sawdust of the sawdust layer on the surface of the foam material layer are not limited, and can be adjusted according to the buffering performance need of the buffer body.

As a preferred solution of the present invention, after the sawdust layer and the foam material layer are pressed and formed in the step S2, the sawdust layers with different shapes and arrangement modes form decorative layers on the surface of the buffer body.

Compared with the prior art, the present invention has the following beneficial effects:

1) The buffer body is composed of the sawdust layer and the foam material layer, and the decorative pattern formed by the sawdust can increase the beauty of the helmet. Through the selection of the sawdust with different shapes, sizes and materials in the sawdust layer, combined with the foam material layer, the performance of the softness and the comfort of the buffer body can be increased according to the processing need of the buffer body and the good feeling of contact between the buffer body of the helmet and the head is improved so that the helmet adapted with the buffer body is more competitive in the market.

2) When the buffer body is processed, the sawdust layer and the foam material layer are pressed and formed only by extrusion and high temperature steam processing. Compared with the buffer body decorated by the technologies of coating with color ink and film, the buffer body of the sawdust helmet in the present invention can complete the processing of the buffer body more quickly, the sawdust material is more environmentally friendly while ensuring the beauty and the practicality of the helmet and the production cost of the helmet can be effectively reduced.

DESCRIPTION OF DRAWINGS

The drawings are used to provide further understanding for the present invention and constitute part of the description. The drawings are used to explain the present invention together with the embodiments of the present invention, and do not constitute a limitation to the present invention. In the drawings.

Figure 1:
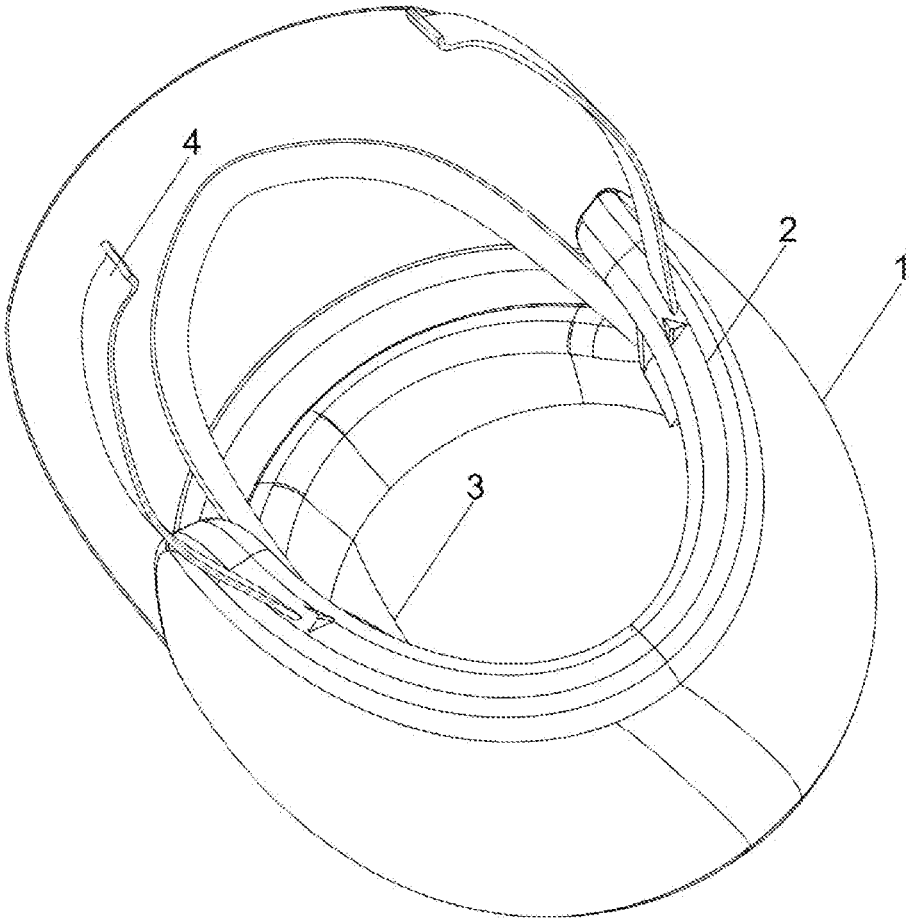
FIG. 1 is a structural schematic diagram of the present invention.
Figure 2:
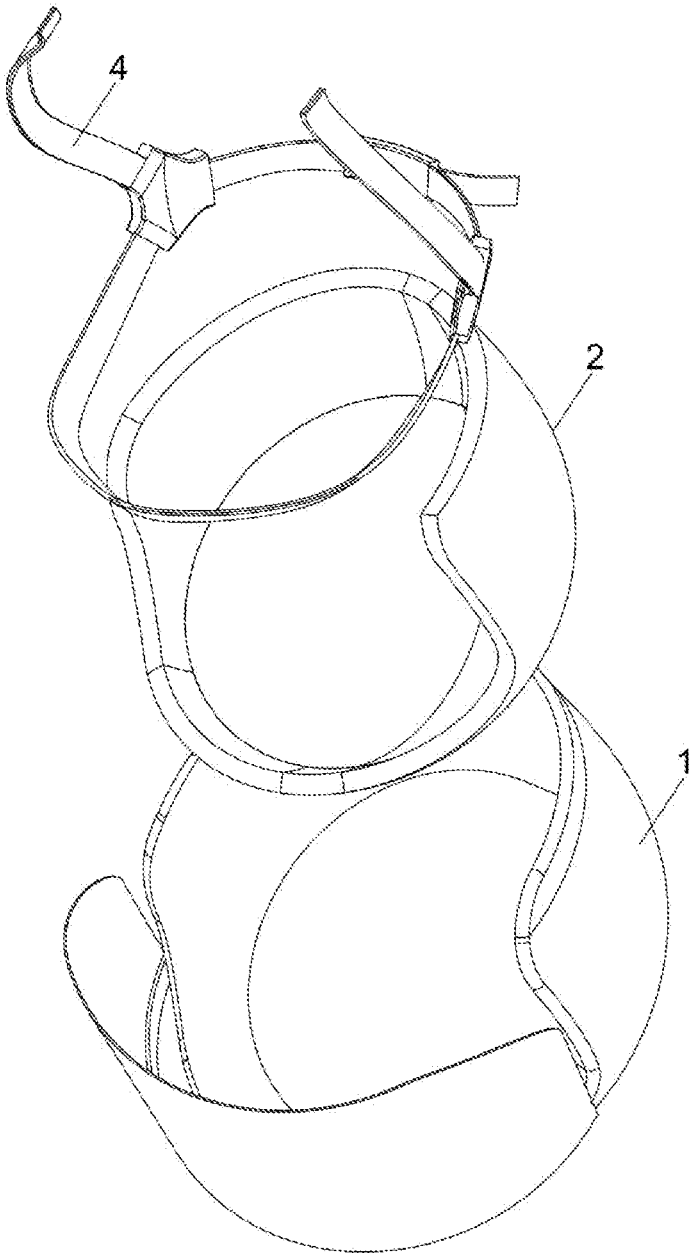
FIG. 2 is a local splitting schematic diagram of the present invention.
Figure 3:
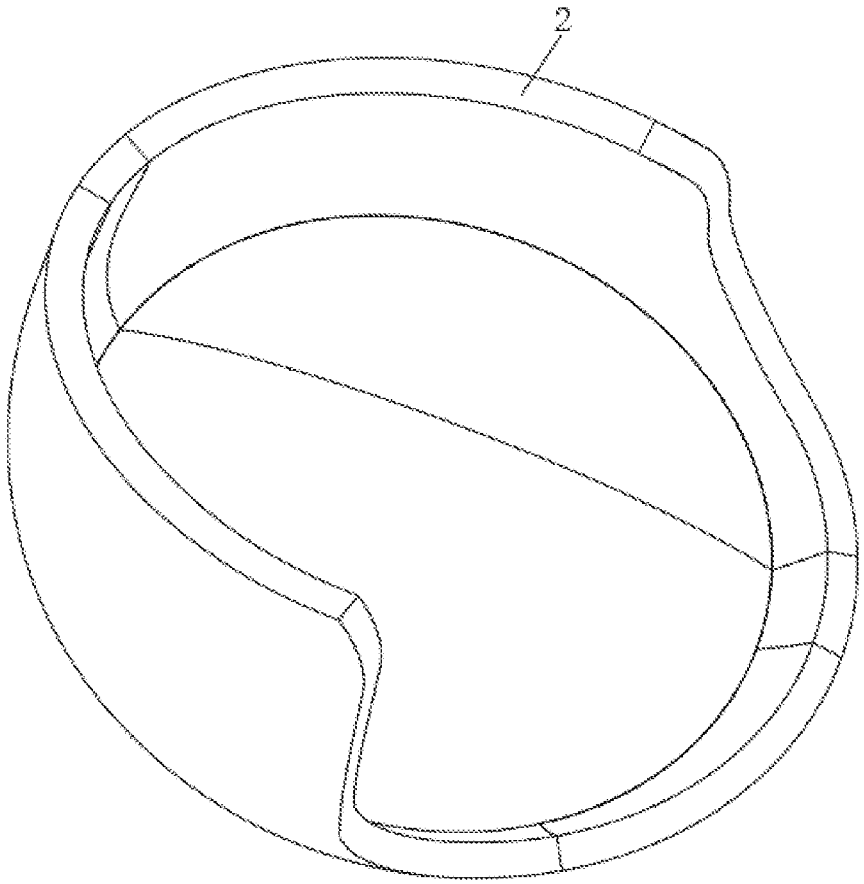
FIG. 3 is a structural schematic diagram of a buffer body of the present invention.

In the drawings: 1 outer housing; 2 buffer body; 21 sawdust layer; 211 bulge; 212 wedge block; 213 sawdust insert; 214 first arc part; 22 foam material layer; 221 groove; 222 wedge groove; 223 embedding groove; 224 second arc part; 3 fabric inner cushion body; 4 helmet belt.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Embodiment 1

By referring to FIGS. 1-4, the present invention provides the following technical solution: a sawdust helmet comprises an outer housing 1; a buffer body 2 containing sawdust is installed at the inner side of the outer housing 1; the buffer body 2 is integrally formed, and the size of the buffer body 2 is adapted with the size of the outer housing 1; a fabric inner cushion body 3 is padded at the inner side of the buffer body 2; and a helmet belt 4 is fixedly installed at the bottom of the outer housing 1. The buffer body 2 is composed of a sawdust layer 21 and a foam material layer 22. The sawdust layer 21 is composed of cork chips or non-cork chips.

Specifically, through the selection of the buffer body 2 processed by integral formation of the sawdust layer 21 and the foam material layer 22, the buffer body 2 can be formed quickly. Because the sawdust material is selected creatively in the buffer body 2, through the selection of the sawdust with different shapes, sizes and materials and combined with the foam material layer 22, the performance of the softness and the comfort of the buffer body 2 can be increased according to the processing need of the buffer body and the good feeling of contact between the buffer body 2 and the head is improved so that the helmet adapted with the buffer body is more competitive in the market. The padded fabric inner cushion body 3 is in contact with the head and has good air permeability, which can further increase the comfort of wearing the helmet. The installed helmet belt 4 can be provided with a belt buckle. When the helmet is worn, the helmet belt 4 is locked by the belt buckle. The helmet is effectively prevented from accidentally slipping off the head of a wearer in the event of an accident.

Figure 4:
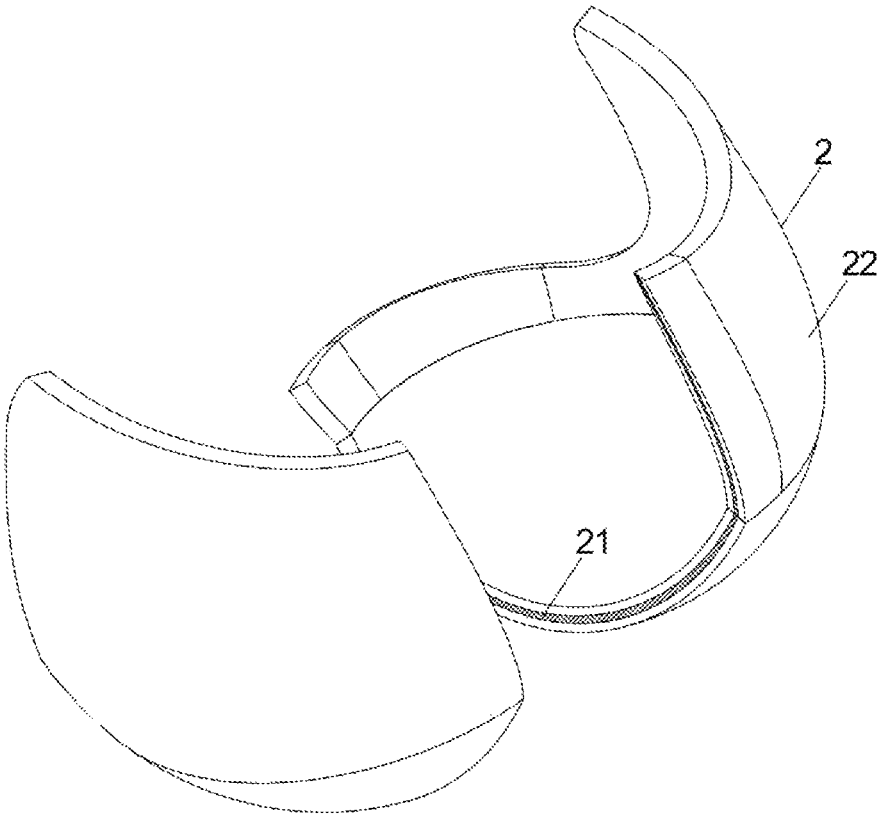
FIG. 4 is a structural schematic diagram of a buffer body in embodiment 1 of the present invention.

By referring to FIG. 4, in the present embodiment: the foam material layer 22 has two layers, and the sawdust layer 21 is pressed in the middle of the two foam material layers 22.

Specifically, two foam material layers 22 are selected, then the sawdust layer 21 is clamped between the two foam material layers 22, and the buffer body 2 is processed by extrusion and high temperature steam processing pressing process. The buffering performance of the buffer body 2 can be effectively ensured by matching the sawdust layer 21 with the foam material layers 22. Of course, those skilled in the art can also select two sawdust layers 21, and then a foam material layer 22 is clamped between the sawdust layers 21 and then molded and processed to obtain the buffer body 2. The buffer body 2 can also be used for providing good buffering performance for the helmet.

Embodiment 2

Figure 5:
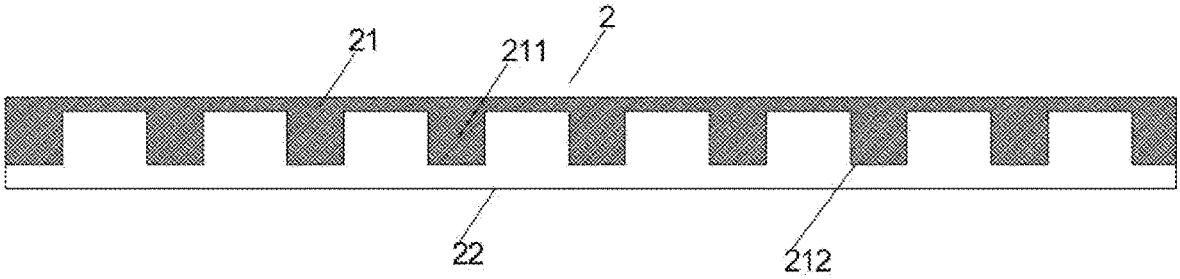
FIG. 5 is a structural schematic diagram of a buffer body in embodiment 2 of the present invention.

By referring to FIG. 5, in the present embodiment: the foam material layer 22 is provided with a plurality of grooves 221; the sawdust layer 21 is provided with bulges 211 adapted with the grooves 221; and when the foam material layer 22 and the sawdust layer 21 are pressed, the bulges 211 are buckled inside the grooves 221.

Specifically, when the foam material layer 22 is processed, a plurality of grooves 221 are processed at the same time. When the sawdust layer 21 is processed, a plurality of bulges 211 are processed. When the sawdust layer 21 and the foam material layer 22 are pressed and formed by extrusion and high temperature steam processing, the bulges 211 are buckled inside the grooves 221, which can effectively ensure the firmness of the two when pressed. The sawdust layer 21 provided with a plurality of bulges 211 simultaneously can also change the buffering performance of the buffer body 2, increase the applicability of the buffer body 2 and realize the personalized customization of the buffer body 2.

Embodiment 3

Figure 6:
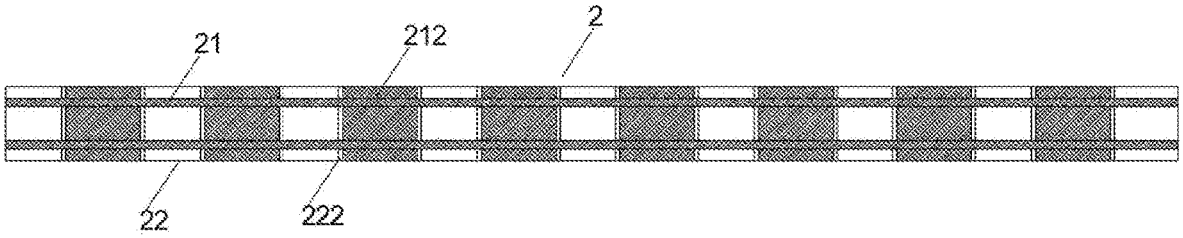
FIG. 6 is a structural schematic diagram of a buffer body in embodiment 3 of the present invention.

By referring to FIG. 6, in the present embodiment: the foam material layer 22 has three layers; the sawdust layer 21 is arranged between two adjacent foam material layers 22, and a plurality of wedge blocks 212 are connected between the two sawdust layers 21 penetratively; the surfaces of the foam material layers 22 are provided with wedge grooves 222 adapted with the sizes of the wedge blocks 212; and when the foam material layers 22 and the sawdust layers 21 are pressed, the wedge blocks 212 are buckled inside the wedge grooves 222.

Specifically, when the foam material layer 22 is processed, a plurality of wedge grooves 222 are processed at the same time. When the sawdust layer 21 is processed, a plurality of wedge blocks 212 are processed individually. When the sawdust layer 21 and the foam material layer 22 are pressed and formed by extrusion and high temperature steam processing, the wedge blocks 212 are buckled inside the wedge grooves 222, which can also effectively ensure the firmness of the two when pressed. The sawdust layer 21 provided with a plurality of wedge blocks 212 simultaneously can also change the buffering performance of the buffer body 2, also increase the applicability of the buffer body 2 and realize the personalized customization of the buffer body 2.

Embodiment 4

Figure 7:
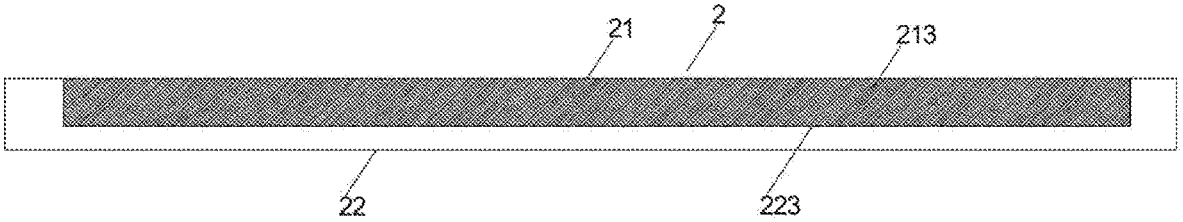
FIG. 7 is a structural schematic diagram of a buffer body in embodiment 4 of the present invention.

By referring to FIG. 7, in the present embodiment: the sawdust layer 21 is a round or polygonal sawdust insert 213; the surface of the foam material layer 22 is provided with an embedding groove 223 adapted with the sawdust insert 213; and when the foam material layer 22 and the sawdust layer 21 are pressed, the sawdust insert 213 is buckled inside the embedding groove 223.

Specifically, when the foam material layer 22 is processed, the embedding groove 223 is processed at the same time. The sawdust insert 213 adapted with the embedding groove 223 is processed as the sawdust layer 21. When the sawdust layer 21 and the foam material layer 22 are pressed and formed by extrusion and high temperature steam processing, the sawdust insert 213 is embedded inside the embedding groove 223, which can also effectively ensure the firmness of the two when pressed. The sawdust insert 213 arranged simultaneously can also change the buffering performance of the buffer body 2, also increase the applicability of the buffer body 2 and realize the personalized customization of the buffer body 2. Through the selection of the sawdust inserts 213 with different shapes, the sawdust layer 21 can form different decorative patterns.

Embodiment 5

Figure 8:
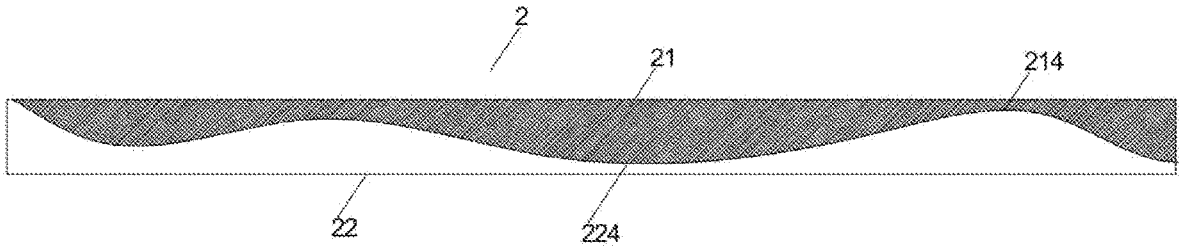
FIG. 8 is a structural schematic diagram of a buffer body in embodiment 5 of the present invention.

By referring to FIG. 8, the bottom of the sawdust layer 21 is provided with a wavy first arc part 214; the surface of the foam material layer 22 is provided with a wavy second arc part 224; and when the foam material layer 22 and the sawdust layer 21 are pressed, the first arc part 214 and the second arc part 224 are closely fitted.

Specifically, when the foam material layer 22 is processed, the second arc part 224 is processed at the same time. When the sawdust layer 21 is processed, the first arc part 214 is processed at the same time. When the sawdust layer 21 and the foam material layer 22 are pressed and formed by extrusion and high temperature steam processing, the second arc part 224 and the first arc part 214 are closely fitted, which can also effectively ensure the firmness of the two when pressed. The first arc part 214 arranged at the same time is matched with the sawdust layer 21, which can also change the buffering performance of the buffer body 2, also increase the applicability of the buffer body 2 and realize the personalized customization of the buffer body 2.

A manufacturing method of the sawdust helmet, used for manufacturing the sawdust helmet of any one of the above, comprises the following steps:

S1, conducting injection molding of the outer housing 1;

S2, processing the buffer body 2 comprising the sawdust layer 21 and the foam material layer 22;

S3, processing the fabric inner cushion body 3; after the buffer body 2 and the outer housing 1 are assembled, padding the inner cushion body 3 at the inner side of the buffer body 2, and then selecting an appropriate helmet belt 4 for installation with the outer housing 1.

In the present embodiment: in the step S2, the sawdust of the sawdust layer 21 is evenly or unevenly distributed on the surface of the foam material layer 22; then the buffer body 2 is processed by extrusion and high temperature steam forming; and the number, size and shape of the sawdust of the sawdust layer 21 on the surface of the foam material layer 22 are not limited, and can be adjusted according to the buffering performance need of the buffer body 2.

Specifically, the buffering performance of the buffer body 2 can be adjusted by flexibly selecting the number, size and shape of the sawdust of the sawdust layer 21.

In the present embodiment: after the sawdust layer 21 and the foam material layer 22 are pressed and formed in the step S2, the sawdust layers 21 with different shapes and arrangement modes form decorative layers on the surface of the buffer body 2.

Specifically, by adjusting the number, size, shape and arrangement mode of the sawdust of the sawdust layer 21, the sawdust layers 21 can form different decorative patterns, which can further realize the personalized customization of the buffer body 2.

Finally, it should be noted that the above description is only a preferred embodiment of the present invention, and is not intended to limit the present invention. Although the present invention is described in detail with reference to the above embodiment, those skilled in the art may still modify the technical solution recorded in the above embodiment, or equivalently replace some of the technical features. Any modification, equivalent replacement, improvement, etc. made within the spirit and the principle of the present invention shall be included within the protection scope of the present invention.

The invention claimed is:

1. A sawdust helmet, comprising an outer housing (1), wherein a buffer body (2) containing sawdust is installed at the inner side of the outer housing (1); the buffer body (2) is integrally formed, and the size of the buffer body (2) is adapted with the size of the outer housing (1); a fabric inner cushion body (3) is padded at the inner side of the buffer body (2); and a helmet belt (4) is fixedly installed at the bottom of the outer housing (1);

the buffer body (2) is composed of a sawdust layer (21) and a foam material layer (22);

the sawdust layer (21) is composed of cork chips or non-cork chips;

wherein the foam material layer (22) has three foam material layers; the sawdust layer (21) has two sawdust layers each arranged between two adjacent foam material layers (22), and a plurality of wedge blocks (212) are connected between the two sawdust layers (21) penetratively; the surfaces of the foam material layers (22) are provided with wedge grooves (222) adapted with the sizes of the wedge blocks (212); and when the foam material layers (22) and the sawdust layers (21) are pressed, the wedge blocks (212) are buckled inside the wedge grooves (222).

2. The sawdust helmet according to claim 1, wherein the wedge blocks (212) penetrate in the three foam material layers.

* * * * *